US008550303B2

(12) United States Patent
Greer et al.

(10) Patent No.: US 8,550,303 B2
(45) Date of Patent: Oct. 8, 2013

(54) MULTI-CHAMBERED CONTAINER

(75) Inventors: Les Greer, Sandpoint, ID (US); Brian Worthington, Dunellen, NJ (US); Bruce Cummings, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 558 days.

(21) Appl. No.: 12/612,391

(22) Filed: Nov. 4, 2009

(65) Prior Publication Data

US 2011/0101021 A1 May 5, 2011

(51) Int. Cl.
*B67D 7/06* (2010.01)
*B67D 7/78* (2010.01)

(52) U.S. Cl.
USPC ..... 222/144.5; 222/145.1; 222/213; 222/482; 222/488

(58) Field of Classification Search
USPC ..... 222/94, 129, 136, 144.5, 145.1, 213, 222/482, 488; 401/44–47
See application file for complete search history.

(56) References Cited

U.S. PATENT DOCUMENTS

| | | | | |
|---|---|---|---|---|
| 704,105 | A * | 7/1902 | Read | 222/144.5 |
| 1,535,529 | A | 4/1925 | Hopkins | |
| 3,269,389 | A | 8/1966 | Meurer et al. | |
| 3,506,157 | A * | 4/1970 | Dukess | 222/94 |
| 3,518,018 | A * | 6/1970 | Woods | 401/46 |
| 3,876,112 | A * | 4/1975 | Kramer | 222/132 |
| 4,029,236 | A * | 6/1977 | Carson et al. | 222/135 |
| 4,753,371 | A * | 6/1988 | Michielin et al. | 222/144.5 |
| 4,842,164 | A | 6/1989 | Davis et al. | |
| 5,062,550 | A | 11/1991 | Singh | |
| 5,154,917 | A * | 10/1992 | Ibrahim et al. | 424/44 |
| 5,269,441 | A | 12/1993 | O'Meara | |
| 5,318,203 | A | 6/1994 | Iaia et al. | |
| 5,356,040 | A | 10/1994 | Reggiani | |
| 5,462,526 | A | 10/1995 | Barney et al. | |
| 5,613,623 | A | 3/1997 | Hildebrandt | |
| 5,615,803 | A | 4/1997 | Hatakeyama et al. | |
| 5,628,429 | A | 5/1997 | Usen et al. | |
| 5,716,338 | A | 2/1998 | Hjertman et al. | |
| 5,725,499 | A | 3/1998 | Silverstein et al. | |
| 5,794,819 | A * | 8/1998 | Smith | 222/129 |
| 5,865,345 | A | 2/1999 | Cistone et al. | |
| 5,875,888 | A | 3/1999 | Albisetti | |

(Continued)

FOREIGN PATENT DOCUMENTS

| | | |
|---|---|---|
| DE | 4003921 | 6/1990 |
| DE | 202005002331 | 5/2005 |
| FR | 2811636 | 1/2002 |

OTHER PUBLICATIONS

PCT/US2009/063373 filed Nov. 5, 2009—International Search Report dated Jun. 22, 2010.

*Primary Examiner* — Kevin P Shaver
*Assistant Examiner* — Nicholas J Weiss
(74) *Attorney, Agent, or Firm* — Judy W. Chung

(57) ABSTRACT

A multi-chambered container for storing and dispensing flowable substances and method for using the same. The container includes a plurality of individual chambers each containing a flowable substance. Each chamber is in fluid communication with a discharge valve assembly. The valve assembly selectively dispenses a single one of the flowable substances in response to one of the chambers being pressed or squeezed by a user without simultaneously dispensing the remaining substances. In preferred embodiments, the container includes at least two, and more preferably three or more chambers.

11 Claims, 8 Drawing Sheets

(56) References Cited

U.S. PATENT DOCUMENTS

| | | | | |
|---|---|---|---|---|
| 5,881,869 | A | 3/1999 | Hudson | |
| 5,921,440 | A * | 7/1999 | Maines | 222/145.2 |
| 6,082,588 | A | 7/2000 | Markey et al. | |
| 6,113,257 | A | 9/2000 | Sharon et al. | |
| 6,179,146 | B1 | 1/2001 | Betras | |
| 6,223,942 | B1 | 5/2001 | Markey et al. | |
| 6,223,943 | B1 | 5/2001 | Richmond et al. | |
| 6,247,617 | B1 * | 6/2001 | Clyde et al. | 222/94 |
| 6,276,571 | B1 * | 8/2001 | Clemmons | 222/464.2 |
| 6,299,023 | B1 * | 10/2001 | Arnone | 222/94 |
| 6,325,229 | B1 | 12/2001 | Anders | |
| 6,419,783 | B1 | 7/2002 | Rainey et al. | |
| 6,749,090 | B2 | 6/2004 | Bailey | |
| 6,752,264 | B2 * | 6/2004 | Versluys | 206/219 |
| 7,258,251 | B2 | 8/2007 | Johnson | |
| 7,299,936 | B2 | 11/2007 | Singh et al. | |
| 7,448,556 | B2 | 11/2008 | Muehlhausen et al. | |
| 7,487,888 | B1 * | 2/2009 | Pierre, Jr. | 222/144.5 |
| 7,530,475 | B2 | 5/2009 | Ophardt | |
| 8,074,825 | B1 * | 12/2011 | Ziegler | 220/523 |
| 8,376,183 | B1 * | 2/2013 | Rosen | 222/1 |
| 2006/0021996 | A1 * | 2/2006 | Scott et al. | 222/145.5 |
| 2006/0113318 | A1 | 6/2006 | May et al. | |
| 2006/0175350 | A1 * | 8/2006 | Abramson | 222/129 |
| 2008/0041739 | A1 | 2/2008 | Gayton et al. | |

* cited by examiner

MULTI-CHAMBERED CONTAINER

FIELD OF INVENTION

The present invention relates to containers for storing and dispensing flowable substances, and more particularly to such containers having multiple product storage compartments or chambers.

BACKGROUND OF THE INVENTION

There are many flowable packaged substances or products on the market today offering many choices to consumers for personal care, oral care, and home care products. Such products may include without limitation body washes, liquid soap, body lotions, shampoos, conditioners, household cleaners, etc. Products within the same category are often available in a variety of formulations, colors, and/or fragrances adding to the type and number of products available. However, products are often packaged alone in a single container. Currently, if consumers want to experience more than one product at any time, several individual containers or bottles of products must generally be purchased and stored so that the desired product is available when needed. The purchase of many individual separate containers to obtain the variety of products desired may become a costly proposition and cumbersome to store.

An improved container is desired that provides multiple dispensable products or substances in a single convenient container.

SUMMARY OF INVENTION

A container according to exemplary embodiments of the present invention allows a user to have choice of multiple products in single convenient bottle and dispense only the desired product in lieu of purchasing multiple separate product bottles. In one embodiment, the container incorporates a plurality of individual compartments or chambers into a single unitary structure configured to separately store and selectively dispense multiple flowable products or substances. According to some embodiments, the multi-chambered container preferably provides for the simultaneous storage and dispensing of at least two, and more preferably more than two different types and/or variations of flowable substances from the single container.

A dispensing system incorporated in a multi-chambered container according to embodiments of the present invention, as further described herein, allows the user to selectively dispense the contents of only a single chamber at a given time while precluding products/substances being simultaneously dispensed unintentionally from the other non-selected chambers. In one embodiment, the container includes a flexible sidewall, and is configured and adapted to allow the user to dispense the contents of a single chamber by applying an inward squeezing or pressing force on the container preferably with the hand, thumb, and/or fingers. In some preferred embodiments, the chambers are arranged and stacked vertically when the multi-chambered container is viewed oriented in a lengthwise vertical or upright standing position. This arrangement facilitates a user dispensing one flowable substance from one of the chambers by squeezing the desired chamber at the exclusion of dispensing the remaining substances from the non-selected chambers. Embodiments of the multi-chambered container may also be configured and adapted to allow the chambers to be refillable by the user.

According to one embodiment, a multi-chambered container for selectively dispensing flowable substances includes a first chamber adapted for storing and dispensing a first flowable substance, and a second chamber adapted for storing and dispensing a second flowable substance. In a preferred embodiment, the first and second chambers include flexible sidewalls. The container further includes a common discharge valve assembly in fluid communication with the first and second chambers. The valve assembly is preferably configured and adapted to selectively dispense a single one of the first or second flowable substances in response to application of an inward pressing force on the first or second chamber sidewalls without simultaneously dispensing the remaining substance. In one possible embodiment, the container further includes a third chamber adapted for storing and dispensing a third flowable substance: the third chamber being in fluid communication with the common discharge valve assembly. In this embodiment, the valve assembly is further configured and adapted to selectively dispense a single one of the first, second, or third flowable substances without simultaneously dispensing the remaining substances. In other embodiments, the valve assembly further includes an inlet flow manifold fluidly coupled to each of the chambers and a flexible discharge valve.

The multi-chambered container described herein may be used to store and dispense any flowable substance including liquids or fluids of any viscosity so long as the substance is able to flow. Accordingly, the term "flowable substance" shall be construed to mean any product or material capable of flowing including, but not limited to paste, soap, body wash, shampoo, conditioner, lotion, perfume and the like.

The foregoing and other aspects of exemplary embodiments formed according to principles of the present invention are further described herein.

BRIEF DESCRIPTION OF THE DRAWINGS

The features of the preferred embodiments will be described with reference to the following drawings where like elements are labeled similarly, and in which.

Figure 1:
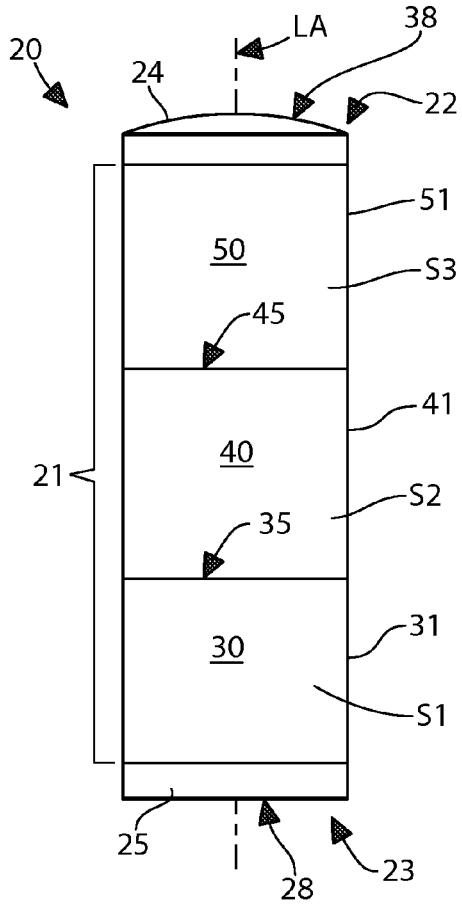
FIG. 1 is a front elevation view of a multi-chambered container closure according to one exemplary embodiment of the present invention.

All drawings are schematic and not actual physical representations of the articles, components or systems described herein, and are further not drawn to scale. The drawings should be interpreted accordingly.

DETAILED DESCRIPTION OF THE INVENTION

This description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower." "upper," "horizontal," "vertical," "above," "below." "up." "down," "top" and "bottom" as well as derivative thereof (e.g., "horizontally," "downwardly." "upwardly." etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected." "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIGS. 1-6 show views of a multi-chambered container 20 according to the exemplary embodiments of the present invention. In the embodiment shown, container 20 may be formed of several segmented substance-containing chambers which are joined together by suitable conventional means known in the art (to be further described herein) to form a unitary container. However, other embodiments of container 20 may be provided in which the chambers are formed as integral parts of the container and not as separate components, as further described herein.

Referring now to FIGS. 1-6, container 20 defines a longitudinal axis LA and includes a top end 22, bottom end 23, and generally vertical container sidewall(s) 21 extending therebetween. Also provided are top closure 24 and bottom closure 25. Bottom closure 25 in one embodiment includes a preferably flat horizontal end surface 28 to allow container 20 to stand upright on a horizontal surface for storage and an annular side skirt 29 extending therefrom in an axial direction. End surface 28 defines an outlet or discharge aperture 27 for dispensing flowable substances from container 20. Top closure 24 includes an end surface 38 and annular side skirt 39 extending axially therefrom as shown. In some embodiments, as shown, top closure 24 may serve to close and seal the top end 52 of uppermost chamber 50.

With continuing reference to FIGS. 1-6, container 20 further includes a first chamber 30, second chamber 40, and third chamber 50 in some embodiments. In some embodiments, the container may have fewer or more chambers. In this embodiment, container sidewall 21 is collectively defined by the sidewalls 31, 41, 51 of chambers 30, 40, and 50 respectively when the chambers 30, 40, 50 are assembled together. Container sidewall 21 may have any suitable and aesthetically pleasing shape or contour. Correspondingly, container 20 may have any suitable cross-sectional shape which is collectively formed by the cross-sectional sidewall 31, 41, 51 shapes of the chambers 30, 40, 50 including without limitation circular, oval/ellipsoidal, polygonal (e.g. composed of any number and/or orientation of linear segments defining an enclosed space), and combinations thereof. In preferred embodiments, sidewall 21 has a generally circular or oval/ellipsoidal shape. Accordingly, it will be appreciated by those skilled in the art that the shape of container 20 need not be uniform in sidewall 21 configuration (as shown in the accompanying figures and exemplary embodiment) and may vary in configuration and dimension from top to bottom in various curved or undulating combinations of shapes.

Each chamber 30, 40, 50 is a generally hollow structure defining an interior space or cavity C providing volumetric capacity for receiving and storing a flowable substance S1, S2, and S3, respectively. Substances S1, S2, and S3 may be similar or different, and in preferred embodiments comprise at least two different substances. With continuing reference to FIGS. 1-6 and particularly FIGS. 2 and 6, chamber 30 includes a sidewall 31 having a generally vertical sidewall surface, a top end 32, and a bottom end 33. Top end 32 and bottom end 33 may be opened or closed. In some embodiments, chambers 40 and 50 may be similarly structured and configured to chamber 30 including, respectively, sidewalls 41 and 51, top ends 42 and 52, and bottom ends 43 and 53 as shown. In other embodiments, chambers 30, 40, or 50 may have different shapes and/or dimensions with varying volumetric capacities depending on the overall intended shape of container 20 and container sidewall 21 once all chambers 30, 40, 50 are assembled together.

The thickness of sidewall 31, 41, and 51 may be uniform or non-uniform along the height and/or circumference of each chamber 30, 40, 50 so long as the overall container 20 is self-supporting when placed on a support surface. Based on the material used for fabricating the chamber sidewalls 31, 41, 51 (to be further described herein) and the material's mechanical properties (i.e. tensile strength, shear strength, modulus of elasticity, etc.), the thickness of the sidewalls is preferably selected so that the chambers 30, 40, 50 may be inwardly and elastically deformed for dispensing flowable substances S1, S2, or S3 when pressed/squeezed by a user, and then return to its original configuration when released. It is well within the ambit of those skilled in the art to select appropriate combinations of materials and thicknesses without undue experimentation to achieve the foregoing functionality.

Figure 2:
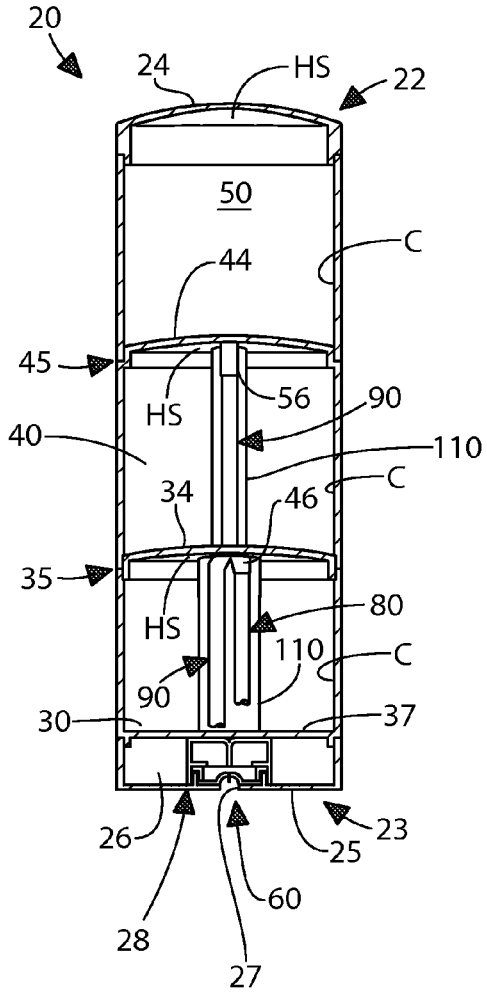
FIG. 2 is a longitudinal frontal cross section taken along line 2-2 in FIG. 3.

Referring to FIG. 2 now, container 20 includes generally horizontal or lateral internal partition walls 34 and 44 which divide the container into a plurality of separate isolated chambers 30, 40, 50 each capable of holding a flowable substance S1, S2, or S3. Partition walls 34, 44 also laterally stiffen container sidewall 21 adjacent the walls to resist deformation for reasons which will become apparent as later described herein. Partition walls 34, 44 are coupled to and radially extend from container sidewall 21 inwards in a direction generally transverse (i.e. perpendicularly and/or angularly) to longitudinal axis LA. In the case where container 20 is formed of conjoined separate chambers 30, 40, 50, as in the exemplary embodiment shown, partition walls 34 or 44 may be molded as a separate component part that is attached between adjacent chambers such as partition wall 34 disposed between chambers 30 and 40 as shown (see also FIG. 6). In other embodiments, partition walls 34 or 44 may be formed and molded as an integral part of one of the chambers such as partition wall 44 of chamber 40 which closes the top 42 of the chamber (see also FIG. 6). Accordingly, any combination of these constructions may be used for the partition walls.

With continuing reference to FIG. 2, partition walls 34, 44 may be configured and adapted to provide headspace HS at the top of each chamber 30, 40, 50. In constructions where container sidewall 21 is made of a transparent or translucent material, any air trapped in the chambers from the initial substance filling process advantageously will be concealed from the user to provide a more aesthetically pleasing appearance rather than creating a line at the air-substance surface visible from the exterior of the container. Partition walls 34, 44 are therefore preferably structured in some embodiments so that a portion of the partition wall defining the headspace HS extends above and vertically up into the bottom of the adjacent chamber. This positions the vertically-extended portions of each partition wall above the seams 35, 45 between adjacent vertically stacked chambers (see FIG. 2). In some embodiments, partition walls 35, 45 may be configured with a domed portion as shown that provides the headspace HS. The headspace HS for the uppermost chamber 50 may be provided by vertically-extended portion of container top closure 24 as shown.

It will be appreciated that the term "generally horizontal" used herein to describe exemplary orientations of partition walls 34, 44 contemplates that at least portions of and/or the entirety of these walls may be disposed at various angles to container sidewall 31 and/or may include a plurality of varying contoured and undulating configurations. This includes allowance for the vertically-extended portions of partition walls 34, 44 that create the headspace HS as noted above. Accordingly, partition walls 34, 44 are expressly not limited to any particular orientation or configuration so long as one chamber 30, 40, 50 may be isolated from the adjoining chamber.

Figure 6:
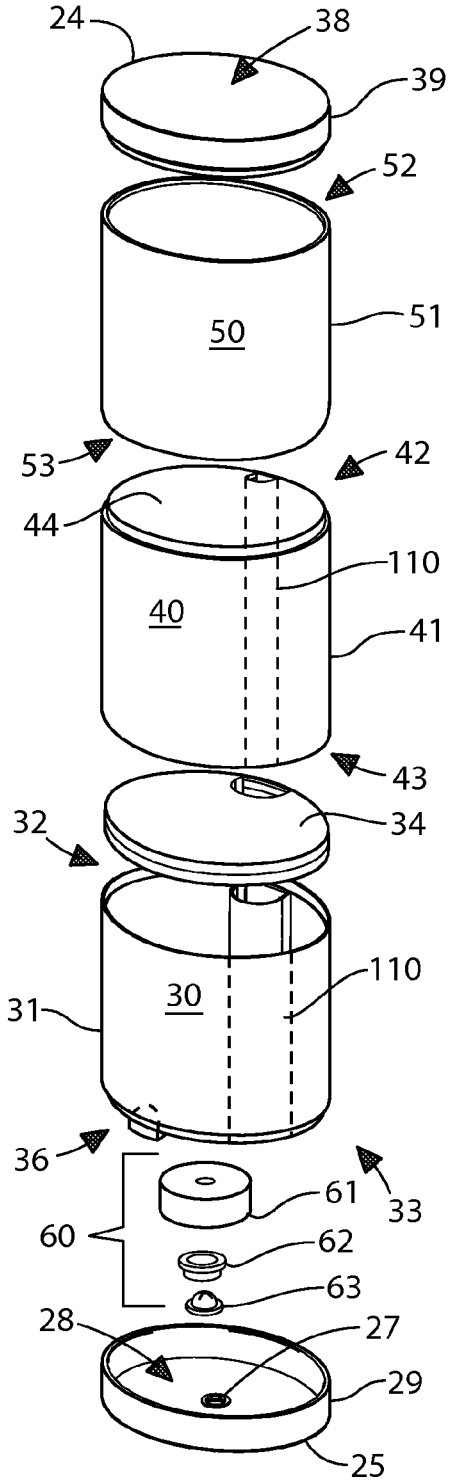
FIG. 6 is an exploded perspective view of the container of FIG. 1.
Figure 7:
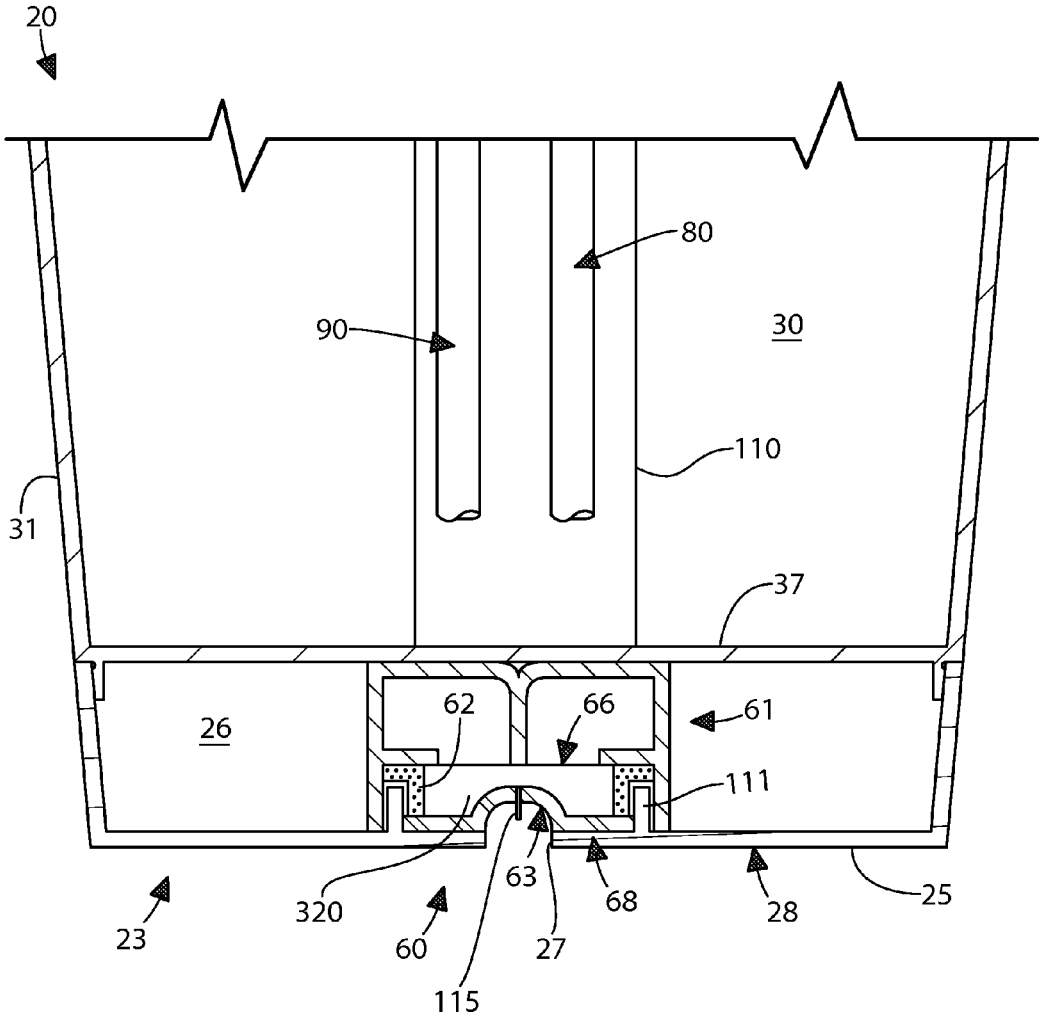
FIG. 7 is a detailed cross-sectional view of the container of FIG. 1 taken along line 7-7 in FIG. 5 showing a lower portion of the container and bottom closure including an exemplary discharge valve assembly.

Referring now to FIGS. 2 and 7, container 20 further includes a radially-extending bottom end wall 37 that closes and seals the bottom end 33 of lowermost chamber 30. In a preferred embodiment, end wall 37 is vertically spaced apart from end surface 28 of bottom closure 25. When bottom closure 25 is seated and attached to container 20, this forms an internal compartment 26 which is bounded by end surface 28 and annular side skirt 29 of bottom closure 23 (see also FIG. 6) and opposing end wall 37. This provides internal space for accommodating portions of a dispensing system for container 20 as further described herein.

According to another aspect of the invention, a dispensing system is provided that fluidly couples or connects each of the chambers 30, 40, 50 to discharge aperture 27 of container 20. Advantageously, the dispensing system is preferably configured and adapted to allow a user to selectively dispense substances S1, S2, or S3. A user can select either only one substance of S1, S2, S3 at a time, or more than one substance S1, S2, S3 from their respective chambers. The user selects how many of the substances are to be dispensed. If only one substance is selected, then it is dispensed without being simultaneously mixed with the remaining substances either internal or external to container 20. If more than one substance is selected by the user, then the selected substances will mix external to the container 20.

The dispensing system will now be described with initial reference to FIGS. 2, 6, 7, and 10. FIG. 7 is a detailed cross sectional view of the lower portion of container 20 and bottom closure 25 taken through discharge valve assembly 60. FIG. 10 is perspective view of one possible arrangement of flow conduits. The dispensing system includes a plurality of flow conduits 80, 90, 100 which fluidly connect chambers 30, 40, and 50 to a common discharge valve assembly 60 disposed in bottom closure 25, which in turn is in fluid communication with discharge aperture 27 in the bottom closure to dispense the selected substance to the user. Accordingly, common discharge valve assembly 60 is in fluid communication with all three chambers. In a preferred embodiment, discharge valve assembly 60 includes an inlet flow manifold 61 (see also FIGS. 8-10) having a plurality of inlet connections or fittings configured and adapted for coupling to the flow conduits from each chamber, as further described herein. Preferably, the flow conduits are designed to isolate substances S1, S2, and S3 from each other when dispensed from their respective chamber 30, 40, 50 so the substances do not mix inside the container.

With continuing reference FIGS. 2, 6, and 7, flow conduit 80 fluidly couples chamber 40 to discharge valve assembly 60. In one embodiment, flow conduit 80 has an upper end connected to an outlet nipple or fitting 46 on chamber 40 and a lower end connected to discharge valve assembly 60, and more specifically to flow manifold 61 in some embodiments, thereby allowing substance S2 to flow through container 20 while remaining isolated from the other substances. In one possible embodiment, as shown, flow conduit 80 may be routed internally through chamber 30. In some other possible embodiments, flow conduit 80 may be routed external to and bypass chamber 30. Either arrangement is suitable and a matter of design and aesthetic preference.

With continuing reference FIGS. 2, 6, 7, and 10 flow conduit 90 fluidly couples chamber 50 to discharge valve assembly 60 and conveys flowable substance S3 in a manner similar to flow conduit 80 described above. Flow conduit 90 has an upper end connected to an outlet fitting 56 on chamber 50 and a lower end connected to discharge valve assembly 60, and more specifically to flow manifold 61. Flow conduit 100 (best shown in FIG. 10) similarly conveys flowable substance S1 and has an upper end connected to an outlet fitting 36 on chamber 30 and a lower end connected to discharge valve assembly 60, and more specifically flow manifold 61 (see FIGS. 6 and 10).

Similarly to flow conduit 80 described above, flow conduits 90 and 100 may be routed internally through the chambers 30 and/or 40 of container 20 in some embodiments, and in other possible embodiments flow conduits 90, 100 may be routed external to and bypass chambers 30 and/or 40 as a matter of design and aesthetic preference. Accordingly, it will be appreciated that in some embodiments one or more of flow conduits 80, 90, 100 may be located on the exterior of container 20. The invention is therefore not limited by the placement of flow conduits 80, 90, 100 on either the exterior or in the interior of container 20 so long as the flow conduits preferably may be coupled to discharge valve assembly 60 and more preferably to inlet flow manifold 61.

With continuing reference to FIGS. 2, 6, and 7, longitudinally-extending tubing channels 110 may be molded into or separately attached to the interior of chambers 30 and 40 for organizing and confining flow conduits 80 and 90 to provide a neat appearance when container 20 is made or a transparent or translucent material. Tubing channels 110 may have any suitable lateral cross-sectional shape (viewed perpendicular to longitudinal axis LA) so long as flow conduits 80 and/or 90 may fit and be routed inside. Preferably, channel 110 disposed in chamber 30 has a larger cross-sectional area than the channel in chamber 40 to accommodate both flow conduits 80 and 90 inside and route both conduits through chamber 30 to discharge valve assembly 60 positioned below.

It should be noted that the flow conduits of the dispensing system in some embodiments may comprise both soft flexible and/or relatively rigid plastic tubular conduits and relatively rigid flow fittings including combinations of all of the foregoing types of tubular conduits and fittings. In one possible embodiment, for example without limitation, flow conduits 80, 90, and 100 may be made of a suitable flexible plastic tubing which can be readily shaped and curved in a routing path between their respective chambers and inlet flow manifold 61 of discharge valve assembly 60. The flow fittings, such as chamber outlet fittings 36, 46, 56 for example, are preferably made of a suitable plastic harder and more rigid than the tubing in a conventional manner for securing the tubing thereto. Additional intermediate fittings (i.e. fittings other than those that may also be used at the termination points of the flow conduits) may also be used. These may include, for example, 30, 45, or 90 degree tubing elbows or straight tubing connectors as commonly used in tubing systems to allow efficient routing of the flow conduits in container 20. In some other possible embodiments, flow conduits 80, 90, and 100 may be formed of a rigid plastic tube that may be integrally molded as part of a chambers 30, 40, 50 or as a separate component.

The coupling between tubing and/or fitting connections may be made by any suitable technique commonly used in the art such as without limitation mechanical couplings (e.g. friction fit, threaded, etc.), ultrasonic welding, adhesives. etc. so long a relatively leak resistant joint is formed.

With continuing reference FIGS. 2, 6, and 7, the dispensing system will now be further described. In one embodiment, discharge valve assembly 60 may be disposed in internal compartment 26 and supported by bottom closure 25. Discharge valve assembly 60 preferably communicates with discharge aperture 27 for dispensing user-selected substances S1, S2, or S3 and may be positioned in any suitable location with internal compartment 26 of bottom closure 25. Discharge valve assembly 60 includes an inlet flow manifold 61 and a preferably elastomeric valve 63 disposed above and communicating with discharge aperture 27. In one possible embodiment, valve 63 is made of silicon; however, any suitable resiliently flexible elastomeric material may be used. In one possible configuration, valve 63 may have a circular shape in top view and includes an arcuately shaped cross-sectional portion as shown (see FIGS. 6 and 7) defining opposing outer concave and inner convex surfaces. The arcuately shaped portion includes a flexible slit or slits 115 of any suitable configuration that form flaps capable of resiliently opening to dispense one of the substances S1, S2, or S3 therethrough, and then returning to a closed position for stopping flow and reducing suckback (i.e. uptake of air back into the container when the user-applied inward pressing or squeezing force is removed from the container). Accordingly, discharge valve 63 preferably functions similarly to a check valve. In one possible embodiment, slits 115 may be X-shaped in configuration.

With continuing reference to FIGS. 2, 6, and 7, discharge valve 63 preferably is positioned proximate to and communicates with discharge aperture 27 to minimize any accumulation of substance or product in the container beyond valve 63. Discharge valve assembly 60 defines an internal flow mixing reservoir 320 (see FIG. 7) in some embodiments which allows two or more flowable substances S1, S2, and S3 to be simultaneously blended or mixed together prior to dispensing through valve 63, as further described herein elsewhere. In one embodiment, valve 63 may secured in position by integral radially-extending flanges 68 which become compressed between a shoulder bushing 62 (preferably made of an elastomeric or rigid plastic material) and a portion of bottom closure 25 as shown in FIG. 7 when the bottom closure 25 is assembled to container 20. Bottom closure 25 may include an annular raised seating surface 111 (best shown in FIG. 7) to receive and retain the bushing 62.

Figure 5:
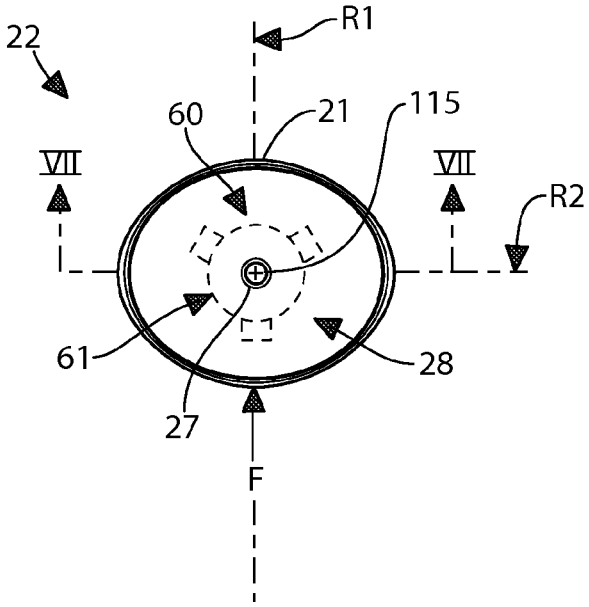
FIG. 5 is a bottom view of the container of FIG. 1.

Preferably, as best shown in FIGS. 5 and 7, valve assembly 60 including inlet flow manifold 61 may be concentrically aligned with discharge aperture 27. In preferred embodiments, valve assembly 60 and discharge aperture 27 are both concentrically and axially aligned with longitudinal axis LA of container 20 as shown. In other possible embodiments, valve assembly 60 and discharge aperture 27 may be positioned off axis with respect to longitudinal axis LA of the container depending on the intended design. Preferably, inlet flow manifold 61 and discharge valve 63 are closely coupled to minimize the length of the flow path therebetween which might otherwise allow for an excessive amount of residual substance or product to accumulate. However, it is possible to separate inlet flow manifold 61 from discharge valve 63 by some distance to accommodate the configuration of the container to be provided.

Figure 8:
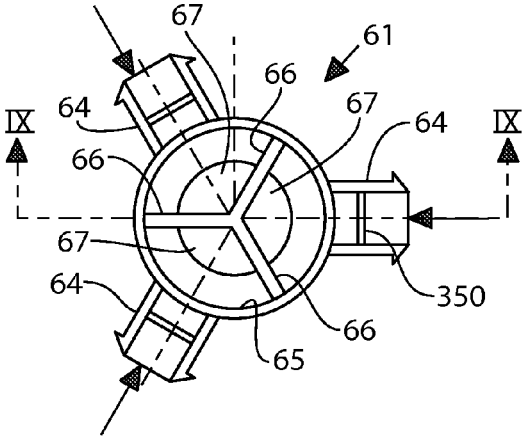
FIG. 8 is a top cross-sectional view through an exemplary inlet flow manifold of the container of FIG. 1.
Figure 9:
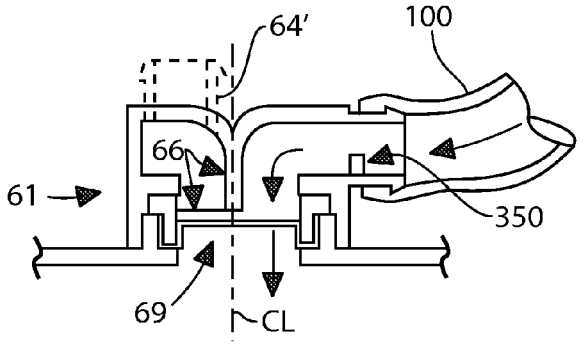
FIG. 9 is a side or elevational cross-sectional view thereof taken along line 9-9 in FIG. 8 showing an exemplary connection of a chamber flow conduit to the manifold.
Figure 10:
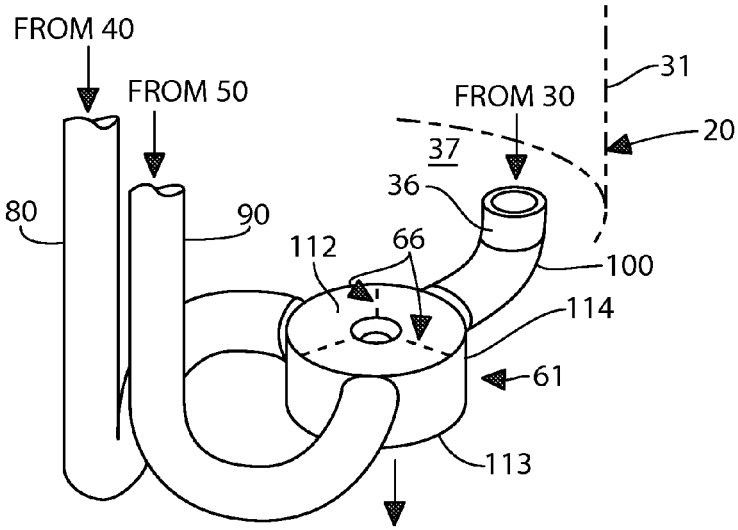
FIG. 10 is an isometric view of the inlet flow manifold of FIG. 8 showing one exemplary arrangement of chamber flow conduits to the manifold.

FIGS. 8-10 show additional views of inlet flow manifold 61 generally disembodied from container 20 for clarity and including flow arrows showing the direction of flow for substances S1, S2, or S3 through the manifold. FIG. 8 is a top cross-sectional view through inlet flow manifold 61. FIG. 9 is a side or elevational cross-sectional view thereof taken along line 9-9 in FIG. 8 showing the connection to flow conduit 100 which would be located towards the front of container 20 in the embodiment described herein (discharge valve 63 omitted for clarity). FIG. 10 is an isometric view of inlet flow manifold 61 showing one possible arrangement of flow conduits 80, 90, and 100 coupled to the manifold. A portion of container 20 and chamber 30 are shown in dashed lines to better illustrate one possible placement of outlet fitting 36 on chamber 30 and flow conduit 100 (located towards the front of the container) which is not as readily visible in the other figures.

The flow manifold 61 will now be further described with reference to FIGS. 2 and 6-10. In one embodiment, inlet flow manifold 61 may be disc or cylindrically shaped and includes an internal cavity 65. Manifold 61 includes internal baffles 66 disposed in cavity 65 that function to keep the substances S1, S2, and S3 separated when each of the substances are dispensed from container 20. In this embodiment, baffles 66 partition cavity 65 off into three internal flow compartments 67 as shown. Preferably, the number of internal flow compartments is equal to the number of chambers provided. Baffles 66 have a sufficient longitudinal extent or height selected to prevent lateral substance or product flow entering the inlet flow manifold 61 from flow conduits 80, 90, 100 from entering another opposing flow conduit inlet to be further described herein. In a preferred embodiment, baffles 66 have height such that the lowest point on the baffle terminates approximately at or below the bottom of inlet fittings 64 as described herein and best shown in FIG. 9 to avoid the foregoing problem.

Depending on the viscosity of the flowable substances S1, S2, and S3 provided, each flow conduit 80, 90, 100 or inlet flow manifold 61 may be furnished with a flow restrictor 350 preferably disposed upstream of discharge aperture 27 to ensure that excessive amounts of the substances from each chamber 30, 40, 50 do not seep into the manifold and comingle. In some possible embodiments, the flow restrictor 350 may an openable/closeable one-way flexible valve similar to discharge valve 63 or a fixed permanently open reduced diameter flow aperture either of which may be disposed within flow conduits 80, 90, 100 and/or inlet flow manifold 61. In one possible embodiment shown in FIGS. 8 and 9, the flow restrictor 350 may be an orifice such as a partial height wall or conventional circular orifice plate (not shown) disposed in inlet fitting 64 as shown or elsewhere in flow manifold 61. Accordingly, the flow restrictor 350 may be any suitable valve or orifice structure so long as excessive amounts of flowable substances S1, S2, and S3 are prevented from seeping into inlet flow manifold 61. It is well within the ambit of those skilled in the art to select an appropriate one-way valve and/or orifice size based on the viscosity of flowable substances S1, S2, and S3 to accomplish the foregoing functionality.

Inlet flow manifold 61 further includes a plurality of inlet connections or fittings 64 as best shown in FIGS. 7-10. Inlet fittings 64 extend radially and laterally outward from inlet flow manifold 61 and are configured and adapted for coupling to flow conduits 80, 90, and 100. In preferred embodiments, as shown, inlet fittings 64 may be radially aligned with the flow manifold axial centerline CL and perpendicular to lateral side 114 (best shown in FIG. 8). However, one or more of inlet fittings 64 may be aligned tangentially and/or obliquely to centerline CL and side 114 of manifold 61 in other embodiments depending on the routing of flow conduits 80, 90, 100 if more convenient. The foregoing arrangements of the inlet fittings 64 introduces flow laterally into the flow manifold 61. Flow manifold 61 has a single flow outlet 69 as shown which communicates with discharge valve 63 which preferably is positioned closely below the manifold outlet in some embodiments (see FIG. 7). The number of inlet fittings 64 preferably matches the number of chambers 30, 40, 50 provided. As shown, inlet flow manifold 61 in this embodiment includes three inlet fittings 64.

The inlet fittings 64 of flow manifold 61 may be disposed at any suitable position on the outer circumference of inlet flow manifold 61 and separated from each other by any suitable angle dictated at least in part by providing the most efficient arrangement depending on the configuration and routing used for flow conduits 80, 90, and 100. The position of each inlet fitting 64 is also dictated by the baffle 66 arrangement provided so that each fitting 64 preferably is located to fluidly communicate with only one of the internal flow compartments 67 as shown in FIGS. 8-10.

In other possible embodiments, one or more of the inlet fittings may be located on the top 112 of flow manifold 61 in lieu of on the lateral sides 114 thereof so that flow enters into the manifold from the top. These alternate top-entry inlet fittings 64' (illustrated in dashed lines in FIG. 9) in such an arrangement would be provided such that each inlet fitting still only aligns and communicates with one of the internal flow compartments 67. This alternate arrangement allows for close or direct coupling between the lowermost chamber 30 and inlet flow manifold 61 and may be more desirable and/or convenient for connections to the other flow conduits 80 or 90 in some embodiments. In some embodiments, therefore, flow conduit 100 may be eliminated and a top-entry inlet fitting 64' (see, e.g. FIG. 9) may be provided to directly connect flow manifold 61 to chamber 30 such as via a flexible elastomeric sealing bushing seated in bottom end wall 37 above the flow manifold inlet fitting 64' (not shown, but readily understandable by those skilled in the art without illustration). Accordingly, the combination of possible inlet fitting 64 and/or 64' positions described herein provide considerable design flexibility for routing flow conduits 80, 90, and 100 through container 20 to the inlet flow manifold 61.

In one possible embodiment, inlet fittings 64 on manifold 61 may include conventional annular tubing barbs as shown in FIGS. 8 and 9 to help secure the connections to flow conduits 80, 90, 100 in the situation where at least the portion of these flow conduits immediately upstream of flow manifold 61 are formed of flexible tubing. Other suitable conventional inlet fitting configurations may be provided depending on the type of flow conduit connections that are required to be made.

It will be appreciated that flow conduits 80, 90, 100 may be located and routed in any suitable manner through container 20. Accordingly, the invention is not limited to any particular placement or configuration of the flow conduits so long as they may fluidly connect to chambers 30, 40, 50 and terminate at inlet flow manifold 61 of valve assembly 60.

It will be appreciated that numerous suitable configurations are contemplated and possible for valve assembly 60 and inlet flow manifold 61 so long as the flow conduits from each chamber 30, 40, 50 may be fluidly coupled to the valve assembly each corresponding substance S1, S2, or S3 may selectively discharged from container 20 without dispensing the non-selected substances. Accordingly, the valve assembly and inlet manifold 61 are not limited to the configurations shown and described herein.

A multi-chambered container 20 according to the present invention is preferably formed of a material that is at least partially flexible/resilient with a shape memory so as to be non-permanently and elastically deformable by a user when applying an inward pressing or squeezing force F to dispense the contents of one of the chambers 30, 40, 50. Preferably, the material will then allow the squeezed container to return to its original shape when the force is removed. In some embodiments, preferably, container 20 may be made of any suitable conventional thermoplastic material commonly used in the art so long as the material has the mechanical properties that allow it to deform temporarily when squeezed by a user, and then return to its original undeformed shape. Some exemplary embodiments of suitable thermoplastics that may be used include, without limitation, polypropylenes (PP), polyethylenes (PE), polyethylene terephthalate (PET/PETE), polystyrenes (PS), polycarbonate, etc. In some preferred embodiments, the material selected for the multi-chambered container has properties of being transparent or translucent to allow the product and its color stored inside to be seen by the user.

Multi-chambered container 20 may be constructed in various suitable manners. In some possible embodiments, chambers 30, 40, 50 of the multi-chambered container may each be individually molded separately and then joined together by any suitable means commonly used in the art to form a unitary container such as without limitation ultrasonic welding, adhesives, mechanical coupling such as snap locking, shrink or press fitting, etc. Alternatively, in other possible embodiments, chambers 30, 40 50 may be molded and formed as integral parts of a single larger container 20 fabricated together in one or more steps. Accordingly, the present invention contemplates at least both foregoing possible types of the fabrication techniques for container 20 and chambers 30, 40, 50, and is not limited to either.

In either of the foregoing fabrication scenarios, the multi-chambered container 20 and chambers 30, 40, 50 may be formed by any conventional suitable means used in the art such as blow molding, injection molding, or vacuum forming as some non-limiting examples.

Operation of the multi-chambered container 20 according to embodiments of the present invention will now be described with reference to the figures. Preferably, dispensing of flowable substances S1, S2, and/or S3 from container 20 is actuated by applying an inward squeezing or pressing force on one or more of chambers 30, 40, 50 as described below. FIG. 14 is a flow chart summarizing the flowable substance dispensing steps which follow. A single flowable substance dispensing operating mode of the container 20 is first described. To dispense one of the flowable substance S1, S2, or S3 from container 20 (FIG. 14, step 400), a user first selects which substance is desired to be dispensed (FIG. 14, step 402). The user then applies an inward squeezing or pressing force F on the flexible sidewall of chamber 30, 40, or 50 (FIG. 14, step 404) corresponding to the selected substance (see, e.g. FIGS. 3 and 5). The inward pressing force F is preferably applied in a direction toward the longitudinal axis LA (or axial centerline of the container), but need not necessarily be applied precisely in that direction to dispense the selected substance. In the case where the container has a cross-sectional shape (i.e. when viewed perpendicular to longitudinal axis LA) with a larger dimension along one lateral or radial axis (e.g. axis R2 in FIG. 5) than along another second radial axis (e.g. axis R1 in FIG. 5), such as the elliptical/oval container 20 shown (see FIG. 5), the larger container sidewall 21 portion along axis R2 will be somewhat structurally weaker than the shorter container sidewall 21 portion along axis R1 and more flexible. Accordingly, a user may preferably apply the inward pressing force F in the general direction of radial axis R1 by pressing or squeezing somewhere along the larger container sidewall 21 side. However, the shorter side of the container along the R1 axis is preferably structured to be sufficiently flexible so that the user may apply a radial inward force F anywhere along the circumference of sidewall 21 to dispense the selected flowable substance. Although a single force F is shown in the figures, it will be appreciated that during use a user may conveniently apply dual inward forces F essentially simultaneously on opposing container sidewalls 21 such as when squeezing container 20 between the thumb and fingers. Accordingly, actuation of container 20 to dispense flowable substances S1, S2, and/or S3 may be accomplished by the application of numerous different squeezing or pressing forces F on the container sidewalls 21 so long as one or more of chambers 30, 40, 50 are pressurized.

It will be appreciated that in some operating methods or modes of using multi-chambered container 20, a user may select more than one flowable substances S1, S2, S3 for dispensing simultaneously by applying an inward pressing force F on more than chambers 30, 40, 50 at the same time (FIG. 14, step 408). For example, a user may simultaneously apply a force F on chambers 30 and 40, 30 and 50, 40 and 50, or 30, 40, and 50 to simultaneously dispense multiple substances S1, S2, and S3 (FIG. 14, step 410). In some embodiments of containers having more or less than three chambers 30, 40, 50 as shown herein, the same foregoing dispensing methodology may be applied to selectively dispense multiple substances S1, S2, and S3. According, exemplary methods of using container 20 according to present invention advantageously enables a user to create custom mixes or blends of substances S1, S2, and S3. For example, without limitation, if flowable substances S1, S2, and S3 are body washes. S1 may contain a skin exfoliating formulation, S2 may contain a vitamin enriched skin-nourishing formulation, and S3 may contain a moisturizing formula. Depending on the user's particular needs or preferences at a given bathing or washing time, a single one of these S1, S2, or S3 formulations may be dispensed (FIG. 14, steps 404 and 406) or custom blends of any two or more of these formulations may be simultaneously dispensed together and blended (FIG. 14, steps 408 and 410) thereby advantageously combining the benefits and properties of each respective formulation selected. Accordingly, this latter multiple substance custom blending and dispensing operating mode is advantageously provided by multi-chambered container 20 according to the present invention.

Figure 3:
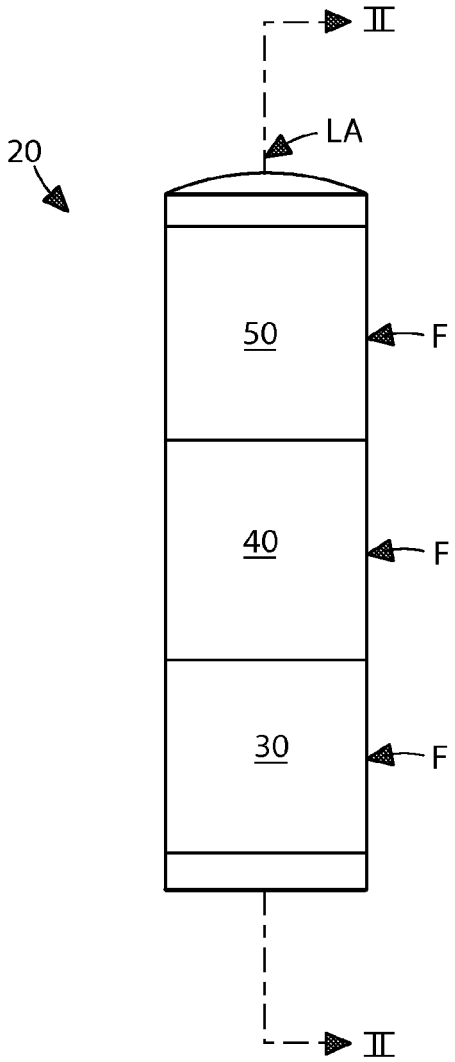
FIG. 3 is a side view of the container of FIG. 1.
Figure 4:
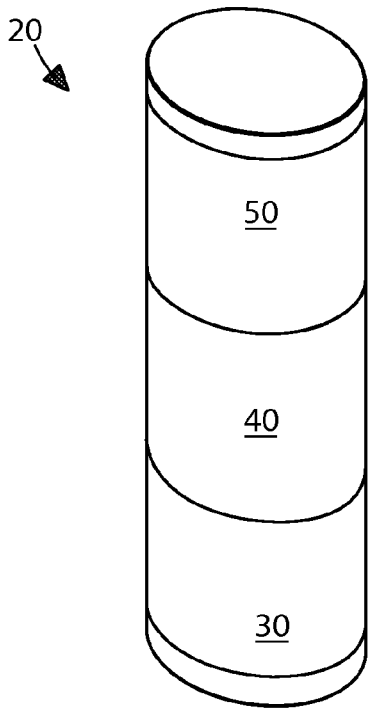
FIG. 4 is a perspective view of the container of FIG. 1.

With primary reference now to FIGS. 2, 3 and 5, and continuing description of the multi-chambered container 20 single substance dispensing operating mode, the flexible sidewall 31, 41, or 51 corresponding to the user-selected chamber 30, 40, or 50 (respectively) will deform elastically inwards and be pressured by the reduction in volumetric capacity when inward force F is applied by the user. Substance S1, S2, or S3 corresponding to the selected chamber will therefore be selectively discharged and flow into its respective flow conduit 80, 90, or 100 without simultaneously dispensing the remaining non-selected substances. The lateral partition walls 34 and 44, which separate the chambers 30, 40, 50 (see FIG. 2), laterally brace and radial stiffen the container which helps to resist the pressing force F and deformation of the adjacent non-selected chamber sidewalls 31, 41, and/or 51 to preferably eliminate (or at least minimize) simultaneous dispensing of non-selected substances. With additional reference to FIGS. 8-10, the selected substance S1, S2, or S3 will flow downwards through the container in its respective flow conduit 80, 90, 100 (bypassing the non-selected chambers) and into the corresponding inlet fitting 64 on inlet flow manifold 61. The selected substance S1, S2, or S3 will enter flow manifold 61 (in a lateral direction perpendicular to the longitudinal axis LA in some embodiments), and then change path to flow in an axial direction (see FIG. 9). Substance S1, S2, or S3 will then leave flow manifold 61 through outlet 69 and be dispensed through discharge valve 63 which opens for a period of time corresponding to the application of inward pressing force F on container 20.

When the user stops pressing or squeezing on the selected chamber (i.e. removes inward force F), the inwardly and temporarily deformed chamber sidewall 31, 41, or 51 (depending on the chamber 30, 40, or 50 selected) will elastically return to its original shape or position which lowers the pressure in the chamber back to its initial pre-deformation state. Discharge valve 63 recloses and the substance S1, S2, or S3 will cease being dispensed.

Figure 11:
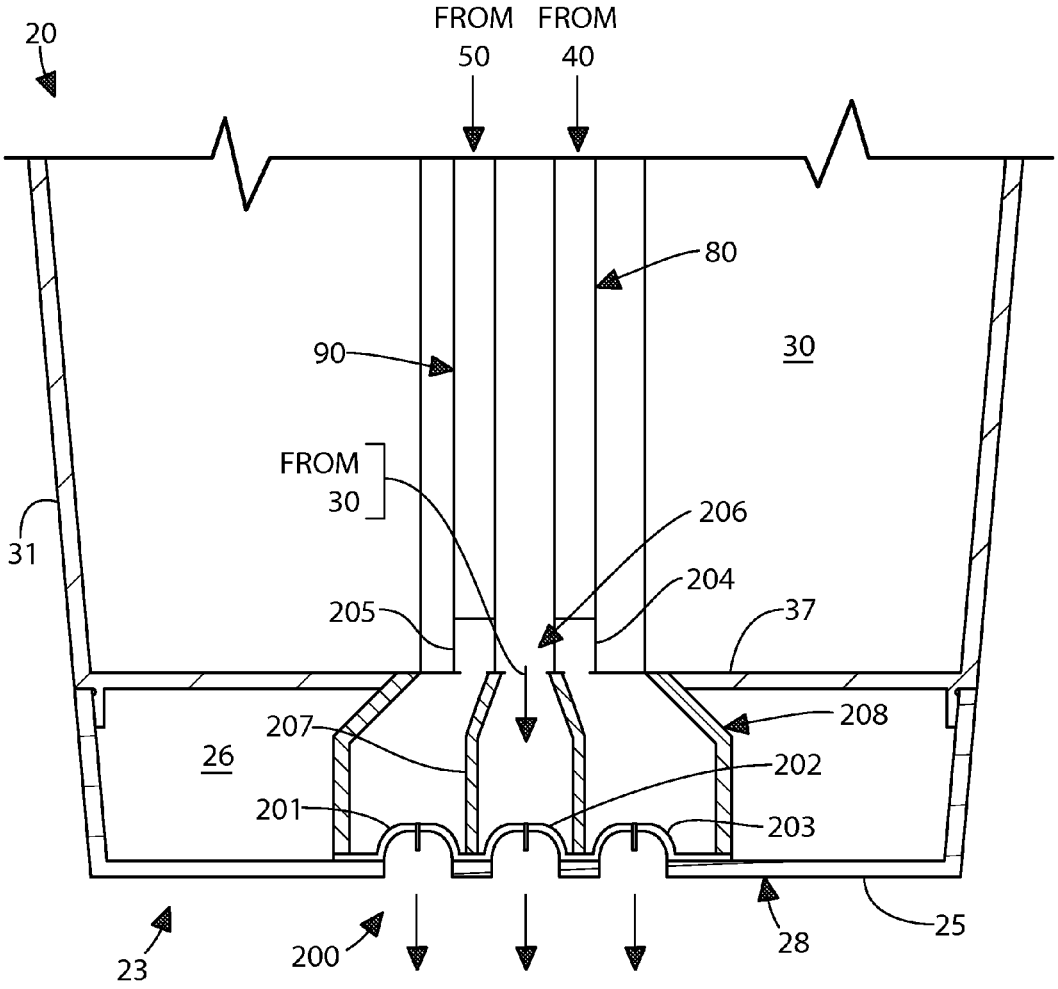
FIG. 11 is a detailed cross-sectional view of the container of FIG. 1 taken along line 7-7 in FIG. 5 showing a lower portion of the container and bottom closure including an alternate embodiment of an exemplary discharge valve assembly.
Figure 12:
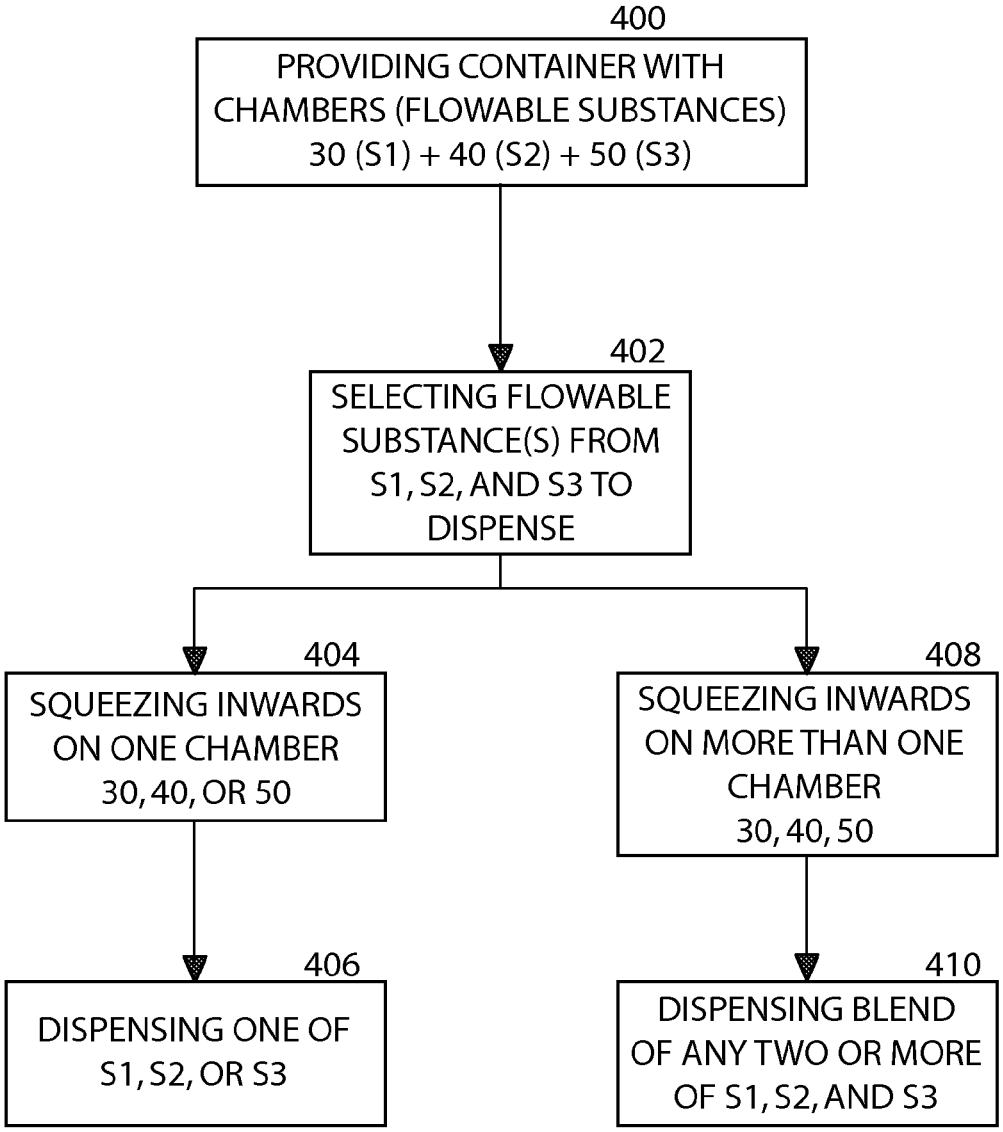
FIG. 12 is a flow chart showing steps of an exemplary method of using the container of FIG. 1.
Figure 13:
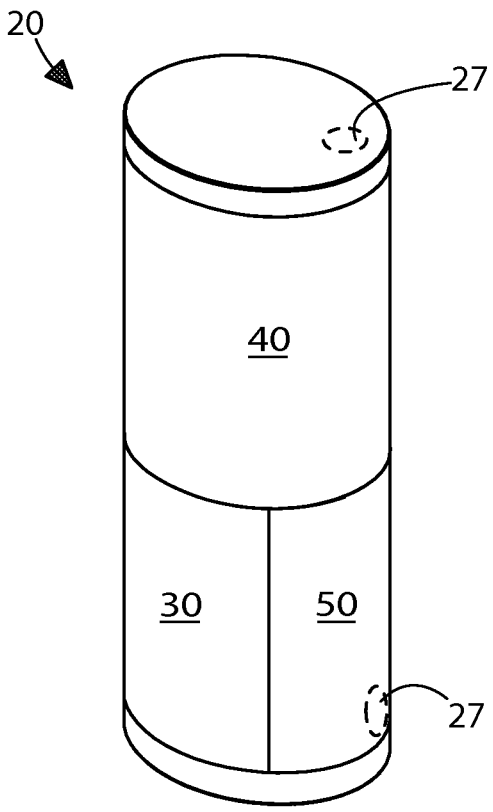
FIG. 13 is a front elevation view of a multi-chambered container closure according to another exemplary embodiment of the present invention.

FIG. 11 shows a variation of a discharge valve assembly 200 for use with multi-chambered container 20 according to principles of the present invention. In lieu of a single discharge valve 63 such as shown in FIG. 7, another embodiment of a discharge valve assembly 200 includes separate discharge valves 201, 202, and 203 as shown, which in one embodiment may be similar to valve 63 already described herein. Flow conduits 80 and 90 from chambers 40 and 50 respectively may be connected to inlet fittings 204, 205 disposed on bottom end wall 37 of container 20. In some embodiments, an orifice 206 may simply be provided in bottom end wall 37 which communicates with chamber 30 allowing the passage of substance S1 directly from the chamber to discharge valve 202. Vertically oriented internal baffles 207 are preferably provided to keep flowable substances S1. S2, and S3 separate upon discharge from container 20. In some embodiments, baffles 207 may be formed as part of a collar assembly 208 which is a separate unit insertable into and attachable to bottom closure 25. Collar assembly 208 may be of any suitable configuration so long as the flowable substances may be kept separated without mixing. When a user selects and squeezes one of chambers 30, 40, or 50, the respective flowable substance S1, S2, or S3 is dispensed through its corresponding valve 201, 202, or 203 as shown (see directional flow arrows).

According to other embodiments of the present multi-chambered container 20, it will be appreciated that flowable substances S1, S2, and S3 need not be dispensed or discharged from each chamber 30, 40, 50 at the bottom end 23 of the container, in a common direction, or from a common end or single location alone as shown and described herein in some embodiments. For example, in other possible embodiments, a valve assembly similar to without limitation 61 or 200 (including three separate discharge valves 63 or 201-203, respectively), or of other suitable similar design, may instead be located at the top end 22 each chamber 30, 40, 50 using a dispensing system including flow conduits such as without limitation those similar to 80, 90, and 100 described herein. According to yet other possible embodiments, at least some of the chambers 30, 40, 50 may dispense their respective flowable substances S1, S2, or S3 from different locations and/or in different directions from each other. Such embodiments may include separate discharge apertures 27 each with an associated discharge valve 63 disposed at different locations on container 20 and chambers 30, 40, 50. It is readily within the ambit of those skilled in the art to reverse the location of the discharge valve assemblies to top end 22, or to locate one or more discharge valve assemblies on container 20 based on the description and principles already provided herein without additional discussion.

Based on the foregoing, it will be readily apparent that numerous variations in dispensing/discharge configurations may be provided according to principles of the present invention so long as a single flowable substance S1, S2, or S3 may be selectively dispensed by a user at the exclusion of the remaining substances.

It will be appreciated by those skilled in the art that although the dispensing method may have been described herein for convenience assuming the container 20 is preferably held in a generally vertical orientation, it is possible to dispense substances S1, S2, or S3 with the container held in any suitable position including horizontally if desired. The substances, however, will be most effectively dispensed if the user holds container 20 anywhere from horizontal to vertical, and any position therebetween. Accordingly, the invention is not limited to any particular orientation of the multi-chambered container when the user dispenses the substance or product.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A multi-chamber container for selectively dispensing flowable substances, comprising:

a top end;

a bottom end;

a plurality of generally vertical container sidewalls extending, between the top end and the bottom end;

a first chamber adapted for storing and dispensing a first flowable substance;

a second chamber adapted for storing and dispensing a second flowable substance, the second chamber being disposed vertically on top of the first chamber and being separated from the first chamber via a lateral partition wall;

the first chamber and the second chamber disposed between the top end and the bottom end, a discharge valve assembly in fluid communication with the first and second chambers, the discharge valve assembly being configured and adapted to dispense a selected first or second flowable substance in response to a squeezing force applied to a selected one of the respective first and second chambers by user without simultaneously dispensing the other flowable substance, wherein the discharge valve assembly has at least one discharge aperture for dispensing the flowable substances from the container, the at least one discharge aperture being located at the top end or the bottom end of the container, and wherein the discharge valve assembly is operable to simultaneously dispense both the first and second flowable substances.

2. The container of claim 1, further comprising:

a third chamber adapted for storing and dispensing a third flowable substance, the third chamber being in fluid communication with the discharge valve assembly, wherein the discharge valve assembly is further configured and adapted to dispense the selected first, second, or third flowable substance.

3. The container of claim 1, wherein the discharge valve assembly further comprises an inlet flow manifold.

4. The container of claim 1, wherein the discharge valve assembly includes a discharge valve operable to open and close.

5. The container of claim 4, wherein the discharge valve assembly has a common single discharge aperture for dispensing the flowable substances from the container.

6. The container of claim 2, wherein the third chamber is disposed laterally adjacent to the first chamber.

7. A user selectable multi-chamber dispensing container comprising:

a top end;

a bottom end;

a plurality of generally vertical container sidewalk extending between the top end and the bottom end;

a first chamber adapted for containing a first flowable substance;

a second chamber adapted for containing a second flowable substance, the second chamber being disposed vertically on top of the first chamber and being separated from the first chamber via a first lateral partition wall;

a third chamber adapted for containing a third flowable substance, the third chamber being disposed vertically on top of the second chamber and being separated from the second chamber via a second lateral partition wall;

and a dispensing system having a separate inlet connection coupled to each of the first, second, and third chambers, and a discharge valve assembly in fluid communication with each of the separate inlet connections to the chambers, the dispensing system being configured and adapted to dispense a selected single one of the first, second, or third flowable substances in response to a squeezing force applied to a selected one of the respective chambers by user without simultaneously dispensing the other remaining substances;

wherein the first, second, and third chambers collectively define parts of a unitary handheld dispensing container, wherein the discharge valve assembly has at least one discharge aperture for dispensing the flowable substances from the container, the at least one discharge aperture being located at the top end or the bottom end of the container, and wherein the discharge valve assembly includes internal baffles that keep the first, second, and third flowable substances separate to prevent mixing of the substances inside the container.

8. The dispensing container of claim 7, wherein the discharge valve assembly includes a discharge valve operable to open and close for controlling the discharge of the flowable substances from the container.

9. The dispensing container of claim 7, wherein the discharge valve assembly is operable to simultaneously dispense two or more of the first, second, and third flowable substances.

10. The dispensing container of claim 7, wherein the discharge valve, assembly further comprises an inlet flow manifold in fluid communication with each of the first, second, and third chambers.

11. The dispensing container of claim 7, wherein the discharge valve assembly is further operable to simultaneously dispense and blend the first and third flowable substances from their respective containers without simultaneously dispensing the second flowable substance from the second chamber.

* * * * *